US010378708B2

(12) United States Patent
Fang

(10) Patent No.: US 10,378,708 B2
(45) Date of Patent: Aug. 13, 2019

(54) ELECTRONIC FOUNTAIN LIGHT WITH BARREL HAVING A BATTER COMPARTMENT SEPARATED FROM A WATER COMPARTMENT AND IMPELLER MAGNETICALLY DRIVEN BY MAGNETIC ROTATING DISK

(71) Applicant: Jian Fang, Dongguan (CN)

(72) Inventor: Jian Fang, Dongguan (CN)

( * ) Notice: Subject to any disclaimer, the term of this patent is extended or adjusted under 35 U.S.C. 154(b) by 56 days.

(21) Appl. No.: 15/811,271

(22) Filed: Nov. 13, 2017

(65) Prior Publication Data

US 2018/0066818 A1 Mar. 8, 2018

Related U.S. Application Data

(63) Continuation of application No. PCT/CN2016/075619, filed on Mar. 4, 2016.

(51) Int. Cl.
*F21S 10/00* (2006.01)
*F21S 9/02* (2006.01)
(Continued)

(52) U.S. Cl.
CPC ..... *F21S 10/002* (2013.01); *B05B 17/08* (2013.01); *F21S 6/001* (2013.01); *F21S 9/02* (2013.01); *F21S 10/005* (2013.01); *F21S 10/04* (2013.01); *B05B 1/36* (2013.01); *F21W 2121/02* (2013.01); *F21Y 2113/10* (2016.08); *F21Y 2115/10* (2016.08)

(58) Field of Classification Search
CPC ..... F21S 10/004; F21S 6/001; F21S 9/02; F21W 2121/02
See application file for complete search history.

(56) References Cited

U.S. PATENT DOCUMENTS 7,784,959 B2 8/2010 Yang
9,423,120 B2 8/2016 Fang
(Continued)

FOREIGN PATENT DOCUMENTS

CN 202998448 U 6/2013
CN 203190392 U 9/2013
CN 203258562 U 10/2013

OTHER PUBLICATIONS

International Search Report of PCT/CN2016/075619, dated Nov. 21, 2016.

*Primary Examiner* — Robert J May
(74) *Attorney, Agent, or Firm* — W&K IP

(57) ABSTRACT

An electronic fountain light, includes a barrel. A separator is provided in a cavity of the barrel. The separator divides the barrel into a water storage compartment and a battery compartment. A first water tank is provided in the water storage compartment. A first illuminant is mounted on the separator. The separator is provided in a concave manner along a direction towards the battery compartment to form a mounting slot. An impeller is mounted in the mounting slot. A plurality of first magnets is fixed on the impeller. A rotating disk and a drive motor for driving the rotating disk to rotate are disposed in the battery compartment. A plurality of second magnets is mounted on the rotating disk. The drive motor drives the rotating disk to rotate, and by means of mutual attraction of the second magnets and the first magnets, the impeller is driven to rotate.

20 Claims, 5 Drawing Sheets

(51) Int. Cl.

| | |
|---|---|
| ***F21S 10/04*** | (2006.01) |
| ***B05B 17/08*** | (2006.01) |
| ***F21S 6/00*** | (2006.01) |
| *F21W 121/02* | (2006.01) |
| *F21Y 115/10* | (2016.01) |
| *F21Y 113/10* | (2016.01) |
| *B05B 1/36* | (2006.01) |

(56) References Cited

U.S. PATENT DOCUMENTS

| | | | | |
|---|---|---|---|---|
| 9,643,204 | B2 * | 5/2017 | Ray | F21S 6/001 |
| 10,132,454 | B2 * | 11/2018 | Li | F21S 9/02 |
| 2009/0135586 | A1 | 5/2009 | Yang | |
| 2015/0338087 | A1 | 11/2015 | Fang | |

* cited by examiner

ELECTRONIC FOUNTAIN LIGHT WITH BARREL HAVING A BATTER COMPARTMENT SEPARATED FROM A WATER COMPARTMENT AND IMPELLER MAGNETICALLY DRIVEN BY MAGNETIC ROTATING DISK

CROSS-REFERENCE TO RELATED APPLICATIONS

This application is a continuation of International Patent Application No. PCT/CN20161/075619 with a filing date of Mar. 4, 2016, designating the United States, now pending. The content of the aforementioned application, including any intervening amendments thereto, are incorporated herein by reference.

TECHNICAL FIELD

The present disclosure relates to a field of electronic lighting device, and particular to an electronic fountain light.

BACKGROUND OF THE PRESENT INVENTION

An electronic candle is the combination of fountain and candle-shaped light body, through the combination of water flow and luminous member to simulate the burning pattern of traditional mineral candles, thus creating a quiet and peaceful atmosphere and making people feel relaxed. Many of the prior electronic candle designs, by using of water pump as power part for water circulation, and the water pump is placed in a sink, thus the wiring section of the water pump is placed outside. In this case, the wiring point requires a strict waterproof treatment, thus making the structure of the electronic candles complex.

SUMMARY OF PRESENT INVENTION

The present disclosure relates to an electronic fountain light, aims to improve performances of insulation and waterproof of the electronic fountain light, and simplify the structure of the electronic fountain light.

To realize the above aim, the present disclosure relates to an electronic fountain light, including a barrel. A separator is provided in a cavity of the barrel. The separator divides the barrel into a water storage compartment and a battery compartment. A first water tank is provided in the water storage compartment. A first illuminant is mounted on the separator. The separator is provided in a concave manner along a direction towards the battery compartment to form a mounting slot. An impeller is mounted in the mounting slot. A plurality of first magnets is fixed on the impeller. A rotating disk and a drive motor for driving the rotating disk to rotate are disposed in the battery compartment. A plurality of second magnets is mounted on the rotating disk. The drive motor drives the rotating disk to rotate, and by means of mutual attraction of the second magnets and the first magnets, the impeller is driven to rotate. A water outlet pipe is disposed in a water storage compartment. One end of the water outlet pipe is in communication with the mounting slot, and the other end is directly or indirectly in communication with the first water tank. A circulating waterway is formed by the water storage compartment, the mounting slot, the water outlet pipe and the first water tank.

Furthermore, the first water tank is provided with the water outlet, and an accommodation cavity is provided to communicate with the water outlet, and a candle flame simulation device is installed in the accommodation cavity.

Furthermore, the first water tank is provided with light guiding fiber, one end of the light guiding fiber is fixed on an inner wall of the accommodation cavity, and the other end of the light guiding fiber is extended to a first illuminant, the light emitted by the first illuminant irradiate the candle flame simulation device through the light guiding fiber, an elevation angle of light emitted by the light guiding fiber is an acute angle.

Furthermore, the inner wall of the accommodation cavity is also provided with a second illuminant, and the elevation angle of light emitted by the second illuminant is the acute angle.

Furthermore, the flame simulation device includes a candle flame simulation plate extended out of the water outlet, and a floating arranged in the accommodation cavity, the float is made of a solid buoyancy material, a bottom end of the candle flame simulation plate is fixed on the floating, a pivot is convexly disposed on periphery wall of the floating, the floating is positioned in the accommodation cavity by using the pivot.

Furthermore, the floating is communicated with a weight ball by using a cable line, the weight ball is disposed in the cavity of the first water tank.

Furthermore, a plurality of first magnets is evenly interval placed on the impeller, and a plurality of second magnets is evenly interval placed on the rotating disk.

Furthermore, the separator is provided in concave manner along a direction towards the water storage compartment to have a light cover, the first illuminant is accommodated in the light cover, the light cover is arranged below the first water tank.

Furthermore, a gap is arranged between the side walls of the first water tank and the water storage compartment.

Furthermore, the water outlet pipe is formed on the separator, a hollow joint is provided on one end of the water outlet pipe which is away from the mounting slot, a water inlet is provided at a bottom of the first water tank, and the water inlet is communicated with the joint.

Furthermore, the water outlet pipe is formed on the sidewall of the water storage compartment, an effluent nozzle is provided on one end of the water outlet pipe which is away from the mounting slot, and a water outlet of the effluent nozzle is provided facing lateral of the first water tank.

Furthermore, the first water tank is provided with an opening, the bottom of the first water tank is communicated with the separator.

Furthermore, a plurality of secondary water tanks is stacked at a top of the first water tank.

Furthermore, a height of the secondary water tanks which are located at the top of the first water tank is lower than that of the effluent nozzle.

Furthermore, the barrel and the separator are molded in one body, the barrel, the separator and the first water tank are transparent or translucent.

Furthermore, the battery compartment is equipped with a battery pack; the battery pack and the drive motor are electrically connected.

Furthermore, the battery pack includes a storage battery and a power adapter to connect an external power supply.

Furthermore, the battery compartment is equipped with a motor permanent seat, the motor permanent seat and the separator are fixedly connected by a screw, and the drive motor is fixed in the motor permanent seat.

Furthermore, a loudspeaker and a control chip are also arranged in the battery compartment, the loudspeaker is electrically communicated with the control chip, and the control chip is provided with a program loading module.

Furthermore, a case is sleeved on outside of the barrel, and the case is made of paraffin or glass.

In the technical solution of the present disclosure, the mounting slot and the water outlet pipe are concavely arranged on the separator, the water outlet pipe is in communication with the mounting slot and the first water tank which is provided in the water storage compartment. The impeller is mounted in the mounting slot, and the battery compartment is provided with the drive motor. The drive motor drives the rotating disk to rotate, and by means of mutual attraction of the second magnets provided on the rotating disk, and the first magnets provided on the impeller, the impeller is driven to rotate. The water in the water storage compartment is inhaled to the mounting slot by the impeller rotating, and then the water is discharged to the water outlet pipe and the first water tank successively. After the first water tank is full of water, the water flows back to the water storage compartment, thus realizing the circulating waterway of the electronic fountain light in the present disclosure. In the present disclosure, the water circulation is driven by the impeller; the drive motor is arranged inside the battery compartment. The drive motor drives the impeller to rotate, and by means of the mutual attraction of the second magnets that is provided on the rotary table and the first magnets, the impeller is driven to rotate. The drive motor is not soaked in the water such that a waterproof treatment is unnecessary, thus making the structure of the electronic fountain light simple.

DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only about some embodiments of the present disclosure, and persons of ordinary skill in the art can derive other drawings from the accompanying drawings without creative efforts.

Label declarations of the figures.

| label | name |
|---|---|
| 100 | barrel |
| 110 | water storage compartment |
| 120 | battery compartment |
| 200 | separator |
| 210 | mounting slot |
| 220 | water outlet pipe |
| 230 | joint |
| 231 | ball |
| 240 | light cover |

-continued

| label | name |
|---|---|
| 250 | effluent nozzle |
| 310 | first water tank |
| 311 | water outlet |
| 312 | accommodation cavity |
| 313 | water inlet |
| 320 | secondary water tank |
| 400 | first illuminant |
| 510 | impeller |
| 520 | first magnets |
| 530 | second magnets |
| 540 | rotating disk |
| 550 | drive motor |
| 560 | motor installation seat |
| 570 | battery pack |
| 600 | case |
| 700 | second illuminant |
| 800 | candle flame simulation device |
| 810 | candle flame simulation plate |
| 820 | floating |
| 830 | pivot |
| 900 | weight ball |

Objective achieving, function features, and advantages of the present disclosure are further described with reference to the embodiments and the accompany drawings.

DETAILED DESCRIPTION OF PREFERRED EMBODIMENTS

Technical solutions of the present disclosure are further described in detail with reference to the accompanying drawings and embodiments. It is to be understood that the specific embodiments described herein are merely used for describing the present disclosure, but are not intended to limit the present disclosure. Based on embodiments in the present disclosure, all other embodiments obtained by those of ordinary skill in the art without making creative work are within the scope of the present disclosure.

It should be noted that the directional terms (such as up, down, left, right, front and rear . . . ) in the embodiments of the present disclosure are merely used to explain the relative positions, the movement situation, etc. of each components in a particular gesture (as shown in the accompanying drawings), and if the particular posture changes, the directional terms also changes accordingly.

In addition, the description of "first", "second" and the like in the present disclosure is used for the purpose of description only, and couldn't construed as indicating or implying its relative importance or implicating the number of the indicated technical features. Thus, the feature that defines "first" "second" may expresses or implicates that it includes at least one of the described features. In addition, the technical solution between various embodiments are combined with each other, but must be based on the realization of those ordinary skill in the art. When the combination of technical solution arises contradictory or can't be achieved, the combination of such a technical solution should be considered as non-existent, and is not within the scope of the disclosure as claimed.

The present disclosure relates to an electronic fountain light.

Figure 1:
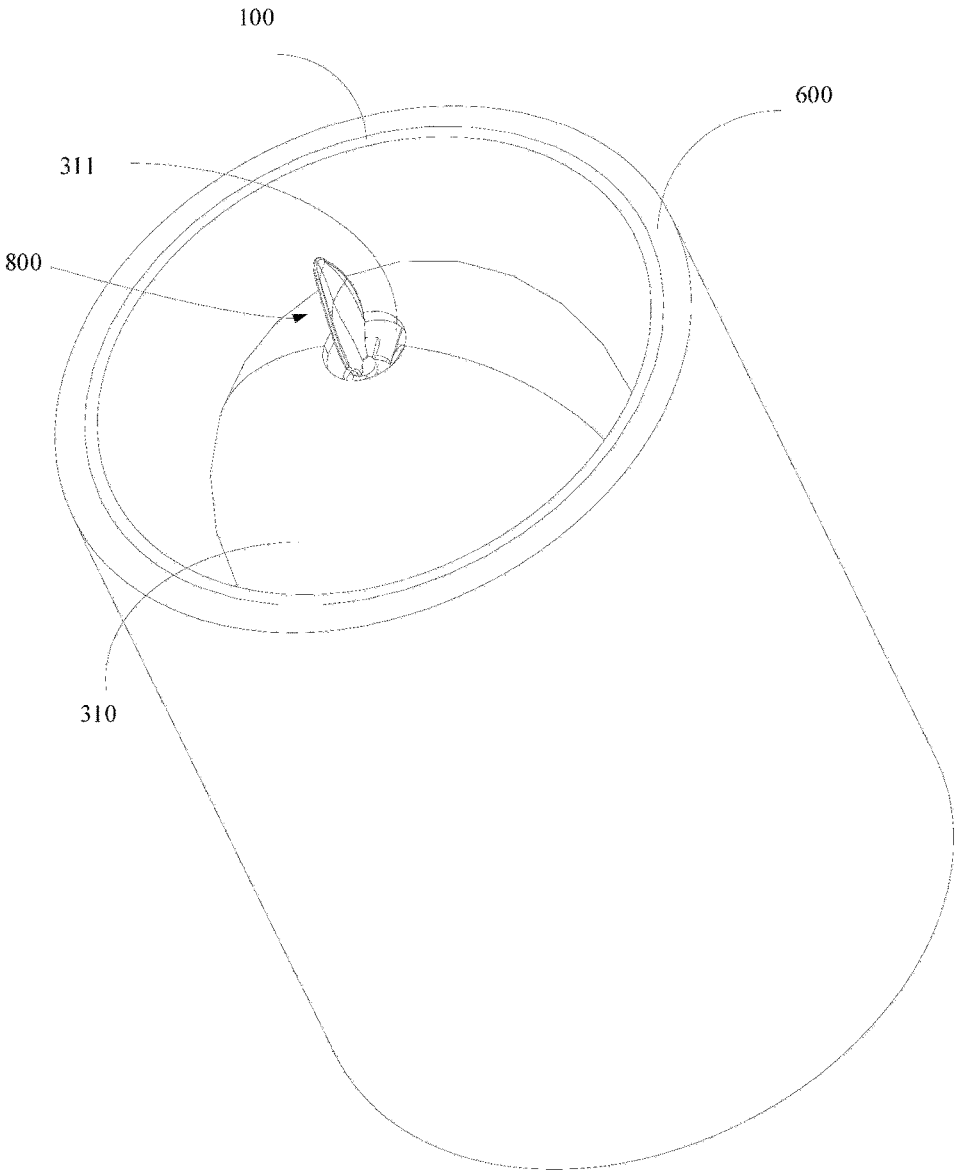
FIG. 1 is a schematic diagram of the electronic fountain light according to an embodiment of the present disclosure.
Figure 2:
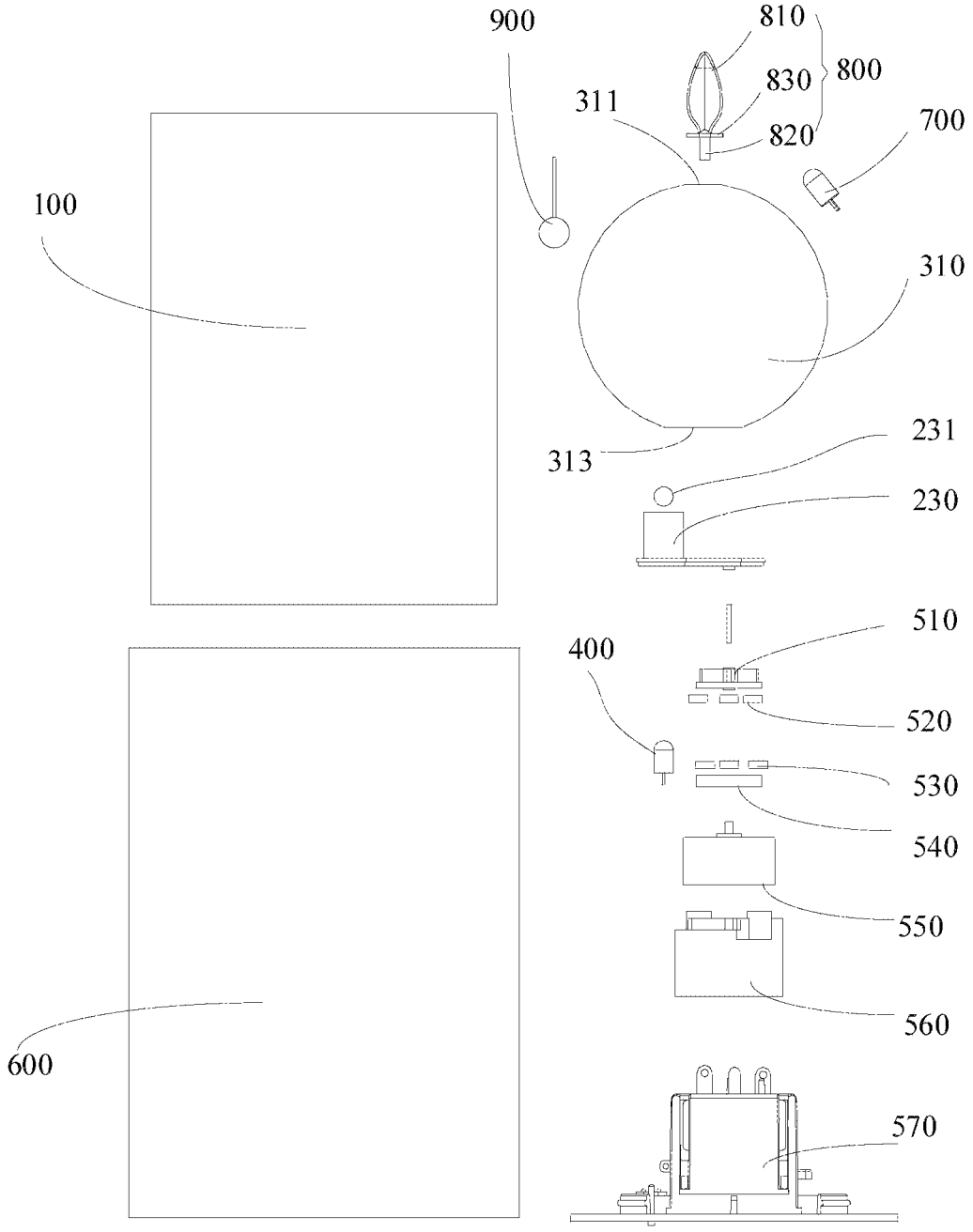
FIG. 2 is an exploded view of the electronic fountain light in FIG. 1.
Figure 3:
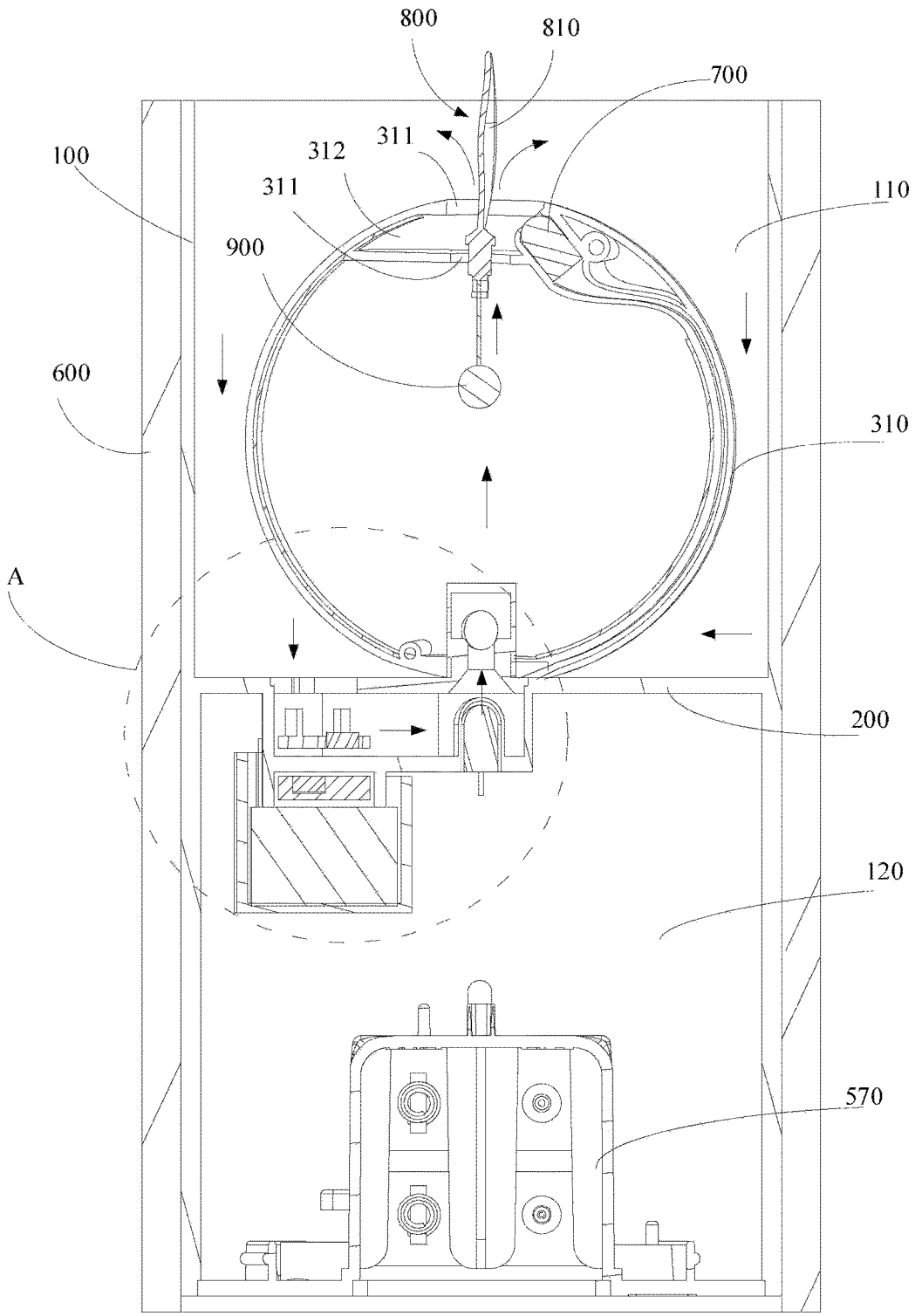
FIG. 3 is a cross-sectional view of the electronic fountain light in FIG. 1.
Figure 4:
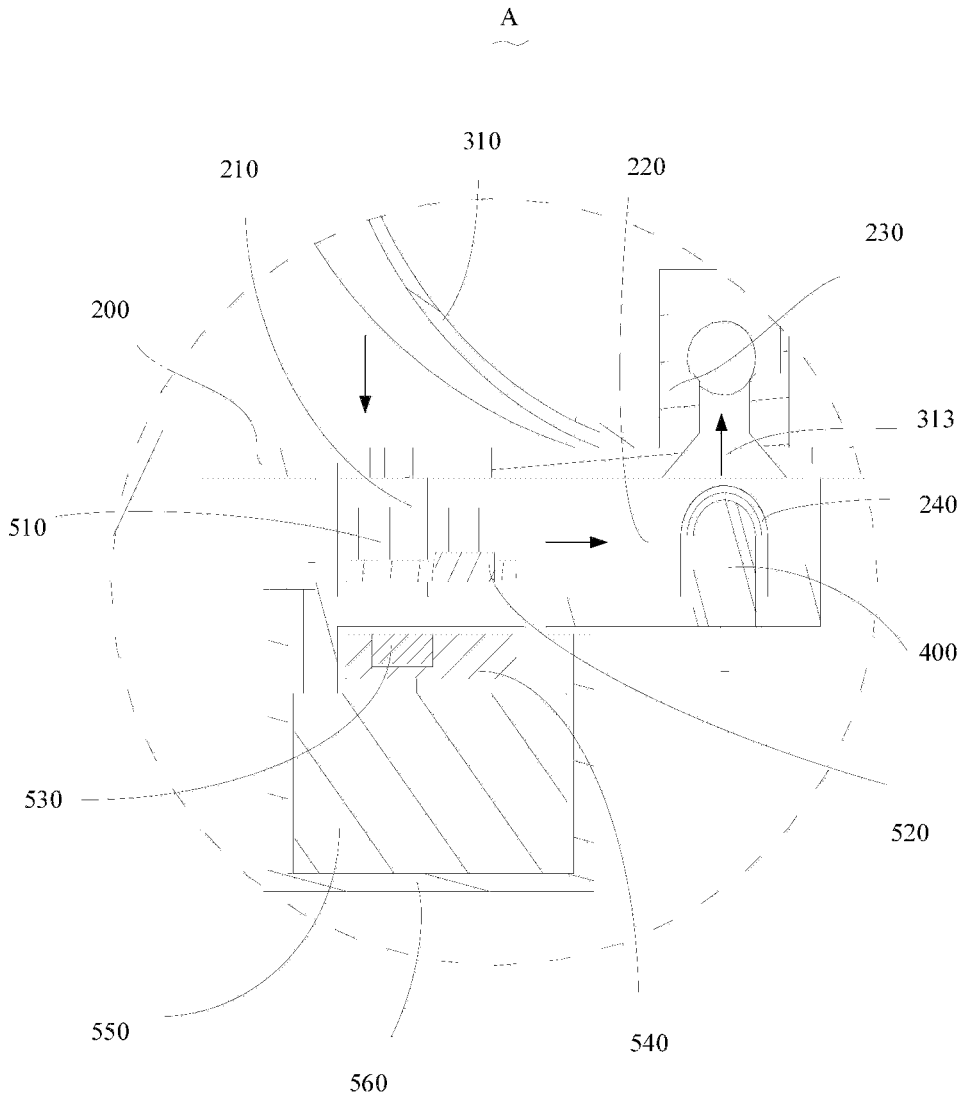
FIG. 4 is an enlargement view of position A in FIG. 3.
Figure 5:
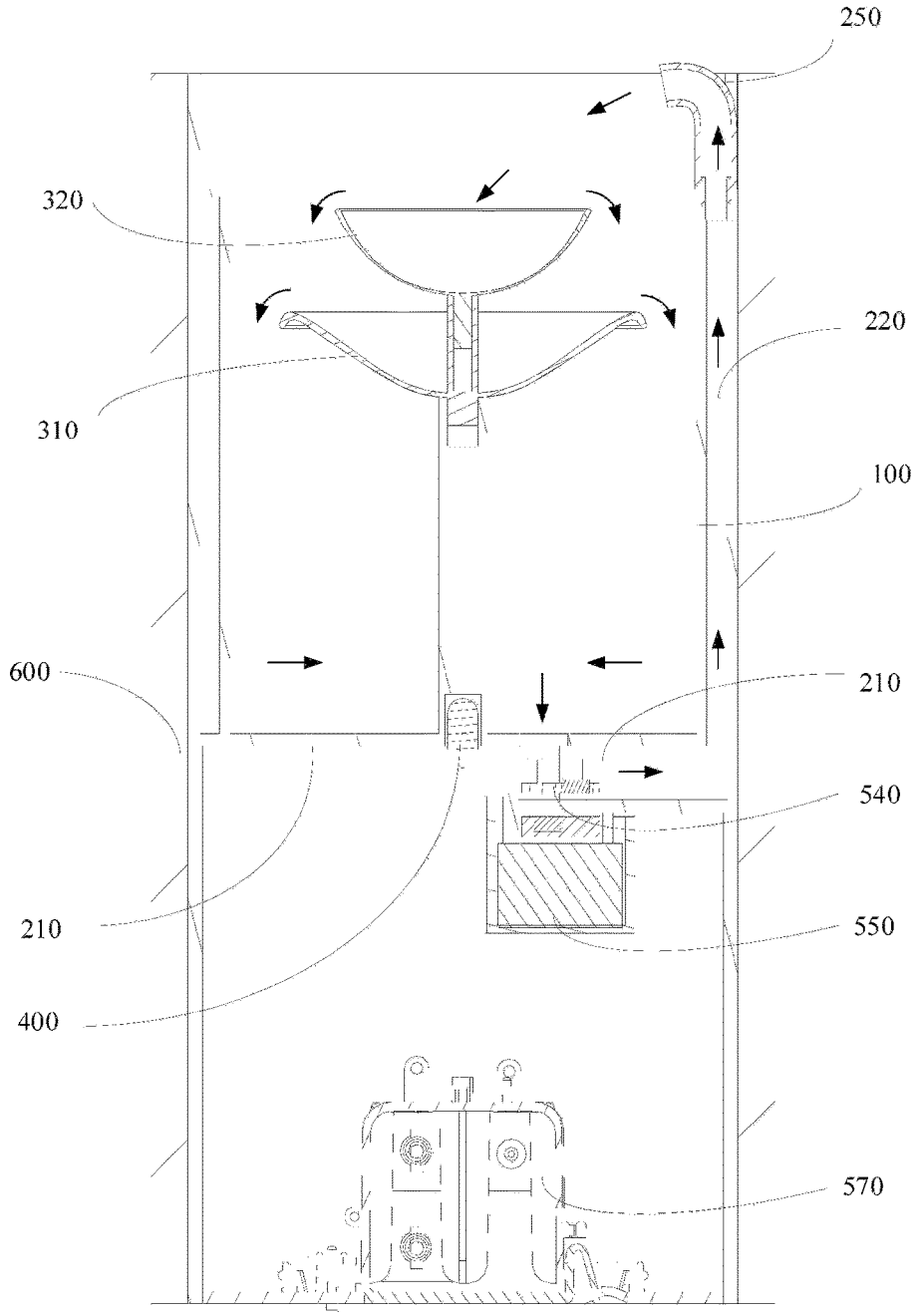
FIG. 5 shows a cross-sectional view of the electronic fountain light in another embodiment of the present disclosure.

With reference to FIG. 1 to 5, FIG. 1 is a schematic diagram of the electronic fountain light according to an embodiment of the present disclosure; FIG. 2 is an exploded view of the electronic fountain light in FIG. 1; FIG. 3 is a cross-sectional view of the electronic fountain light in FIG. 1; FIG. 4 is an enlargement view of position A in FIG. 3;

FIG. 5 is a cross-sectional view of the electronic fountain light in another embodiment of the present disclosure.

With reference to FIG. 1 to 5, an electronic fountain light of the present disclosure, including a barrel 100. A separator 200 is provided in a cavity of the barrel 100. The separator 200 divides the barrel 100 into a water storage compartment 110 and a battery compartment 120. A first water tank 310 is provided in the water storage compartment. A first illuminant 400 is mounted on the separator. The separator 200 is provided in a concave manner along a direction towards the battery compartment 120 to form a mounting slot 210. An impeller 510 is mounted in the mounting slot 210. A plurality of first magnets 520 is fixed to the impeller 510. A rotating disk 540 and a drive motor 550 for driving the rotating disk 540 to rotate are disposed in the battery compartment 120. A plurality of second magnets 530 is mounted on the rotating disk 540. The drive motor 550 drives the rotating disk 540 to rotate, and by means of mutual attraction of the second magnets 530 and the first magnets 520, the impeller 510 is driven to rotate. A water outlet pipe 220 is disposed in the water storage compartment 110. One end of the water outlet pipe 220 is in communication with the mounting slot 210, and the other end is directly or indirectly in communication with the first water tank 310. The water storage compartment 110, the mounting slot 210, the water outlet pipe 220 and the first water tank 310 together form a circulating waterway.

The material of the barrel 100 and the separator 200 may be plastic, the barrel 100 and the separator 200 may be made by an integral injection molding. The barrel 100 may be transparent or translucent. The first illuminant 400 may be a light-emitting diode (LED) light, and a light color of the light may be changed.

In the technical solution of the present disclosure, the mounting slot 210 is concavely arranged on the separator 200, the water storage compartment 110 is provided with the water outlet pipe 220 that is communicated with the mounting slot 210 and the first water tank 310. The impeller 510 is mounted on the mounting slot 210, and the battery compartment 120 is provided with the drive motor 550. A rotation of the drive motor 550 and a mutual attraction of the second magnets 530 that is provided on the rotary table 540 and the first magnets 520 that is provided on the impeller 510 drive the impeller to rotate. The water in the water storage compartment 310 is inhaled to the mounting slot 210 by rotating of the impeller 510, and then the water is discharged to the water outlet pipe 220 and the first water tank 310 successively. After the first water tank 310 is full of water, the water flows back to the water storage compartment 110, thus a water circulation of the electronic fountain light in the present disclosure is realized. In the present disclosure, the water circulation is driven by the impeller 510, and the drive motor 550 is arranged inside the battery compartment 120. The drive motor 550 drive the impeller 510 to rotate because of the mutual attraction between the second magnets 530 and the first magnets 520, no need of waterproof treatment on the drive motor 530 thus makes the structure of the electronic fountain light simple.

A plurality of magnets 520 is evenly interval placed on the impeller 510, and a plurality of second magnets 530 is evenly interval placed on the rotating disk 540. In the electronic fountain light of the present disclosure, the first magnets 520 and the second magnets 530 are permanent magnets, three first magnets 520 and three second magnets 530 are set respectively, the number of the first magnets 520 and second magnets 530 may also be given more than three, so that the impeller 510 is forced uniformly.

The separator 200 is provided in a concave manner towards the direction of the water storage compartment 100 to have a light cover 240, the first illuminant 400 is accommodated in the light cover 240, and the light cover 240 is arranged below the first water tank 400.

Furthermore, the barrel 100 and the separator 200 are molded in one body, the barrel 100, the separator 200 and the first water tank 310 are all transparent or translucent. The material of the barrel 100 and the separator 200 may be plastic, and the barrel 100 and the separator 200 may be made by an integral injection molding. The materials of the first tank 310 may be plastic or paraffin, when the light of the first illuminant 400 illuminates to the first tank 310, the first tank 310 may emit a dim light, to make the people produce a feeling of beauty.

A gap is arranged between side walls of the first water tank 310 and the water storage compartment 110. When the water in the first water tank 310 overflows, the water may fall down from the gap between the first water tank 310 and the water storage compartment 110, thus the water circulation is formed.

With reference to FIG. 1 to FIG. 4, in an embodiment of the present disclosure, the water outlet pipe 220 is convexly disposed on the separator 200, a joint 230 (with reference FIG. 4) is provided on one end of the water outlet pipe 220 which is away from the mounting slot 210, a water inlet 312 is provided at the bottom of the first water tank 310, the water inlet 312 is in communication with the joint 230.

A ball 231 is provided in the cavity of the joint 230.

After the electronic fountain light is started, the impeller 540 is rotated to press the water into the first tank 310. The ball 231 in the joint 230 is driven to roll by the water flow. The light of the first illuminant 400 irradiating the first tank 310 is disturbed so as to perform a sparking effect, thus status of flame flickering in the burning process may be simulated.

Furthermore, a shape of the first water tank 310 is spherical, and a water outlet 311 is provided at the top of the first water tank 310. An accommodation cavity 312 (with reference FIG. 3) is in communication with the water outlet 311. A candle flame simulation device 800 is installed in the accommodation cavity 312.

In a process of using the electronic candle light, the water is gushed out from the water outlet 311, with the driven of the water flow, the candle flame simulation device 800 may swing in the accommodation cavity 312 and the state of flickering in the burning process is simulated, the flame simulation device 800 may be plastic.

The inner wall of the accommodation cavity 312 is also provided with a second illuminant 700, and the elevation angle of light emitted by the second illuminant 700 is the acute angle.

The second illuminant 700 is the LED light, an electrical conductor (not shown) of the second illuminant 700 may be arranged on the inner wall of the first tank 310 and passes through the separator 200 to reach the battery compartment 120, the light of the second illuminant 700 may irradiate the flame simulation device 800, the flame simulation device 800 is driven to swing by the water flow. Meanwhile the light produced by the second illuminant 700 is interrupted and hidden. Under a combined action of the candle flame simulation device 800 and the second illuminant 700, a more realistic effect of a burning flame is created.

It is understandable that, in order to make the light irradiate the candle flame simulation device 800 and create more realistic effect of the burning flame, the second illuminant 700 may be instead by light guiding fiber (not shown), the light guiding fiber is provided at the first water tank 310, one end of the light guiding fiber is fixed on the inner wall of the accommodation cavity 312, and the other end of the light guiding fiber is extended to the first illuminant 400, the light guiding fiber makes the light emitted by the first illuminant 400 irradiate the candle flame simulation device 800, the elevation angle of light emitted by the light guiding fiber is the acute angle.

Specifically, with reference to FIG. 2 and FIG. 3, the flame simulation device 800 includes a candle flame simulation plate 810 which is extended out of the water outlet 311, and a floating 820 which is arranged in the accommodation cavity 312, the floating 820 is made of a solid buoyancy material, a bottom end of a candle flame simulation plate 810 is fixed on the floating 820, a pivot is convexly disposed on the periphery wall of the floating 820, the floating 820 is positioned in the accommodation cavity 312 by using the pivot 830. The floating 820 is made of the solid buoyancy material which is based on polyurethane foam, ceramic and other materials, which have the characteristics of light and corrosion preventive. During the working process of the electronic fountain light of the present disclosure, the floating 820 is driven to swing in the accommodating cavity 312 by the water flow, the candle flame simulation plate 810 is driven to swing at the position of the water outlet 311 by the floating 820. During the swing process, the light that is emitted by the second illuminant 700 or the light guiding fiber is interrupted by the candle flame simulation plate 810, thereby performing a light sparking effect and creating more realistic effect of the burning flame. The pivot 830 in the present embodiment is convexly arranged on two peripheral walls of the floating 820 set opposite with each other. A width between free ends of two pivots 830 is wider than a diameter of the water outlet 311, thus the water stops flowing out. The pivot 830 may limit the position of the candle flame simulation device 800, and the candle flame simulation device 800 won't fall into the cavity of the first water tank 310, and the candle flame simulation device 800 is difficult to break away from the accommodation cavity 312.

The floating 820 is communicated with a weight ball 900, the weight ball 900 is disposed in the cavity of a first water tank 310. The weight ball 900 and the floating 820 can be connected by a cable line. And the setting of the weight ball 900 makes a center of gravity of the candle flame simulation device 800 move downward, and the swing effect of the flame simulator 800 is better under the driving of the water flow.

With reference to FIG. 5, FIG. 5 is a cross-sectional view of the electronic fountain light in another embodiment of the present disclosure. A water circulation loop in the present embodiment is different from that in the first embodiment, the water outlet pipe 220 is formed on a sidewall of the water storage compartment 110, an effluent nozzle 240 is provided on one end of the water outlet pipe 220 which the end is away from the mounting slot 210, the water outlet of the effluent nozzle 240 is provided on a side of the first water tank 310. The water outlet pipe 220 is arranged in the sidewall of the water storage compartment 110, which makes the structure of the electronic fountain light compact.

In the present embodiment, the first water tank 310 is provided with an opening with up direction, the bottom of the first water tank 310 is connected with the separator 200. In the present embodiment, the water is ejected from the effluent nozzle 240 to the first water tank 310 from top to bottom, so that the water flow of the electronic fountain light in the present disclosure is more jumpy.

A plurality of secondary water tanks 320 is stacked at a top of the first water tank 310; the first water tank 310 and the plurality of secondary water tanks 320 compose a cone shape.

The water in the effluent nozzle 240 is first sprayed to the secondary water tanks 320 at the top part of the electric fountain light, and the water falls gradually to form a multistage drop with consequently aesthetic.

The height of the secondary water tanks 320 which are located at the top level is lower than the effluent nozzle 240 so as not to splash water out of the water storage compartment 110.

The electronic fountain light of the present disclosure, the battery compartment 120 is equipped with a battery pack 570; the battery pack 570 and the drive motor 550 are electrically connected. The battery pack 570 is arranged in the battery compartment 120, and the waterproof treatment is unnecessary.

Specifically, the battery pack 570 includes an accumulator (not shown) and a power adapter (not shown) to connect with an external power supply. The electronic fountain light of the present disclosure may be charged through a battery, so that the electronic fountain light of the present disclosure can be freely moved and placed in different places. Of course, the electronic fountain light of the present disclosure may be connected with external power supply by using the power adapter or to charge the battery, to ensure the continuous use of the electronic fountain light of the present disclosure.

The battery compartment 120 is equipped with a motor permanent seat 560, the motor permanent seat 560 and the separator 200 are fixedly connected by a screw, and the drive motor 550 is fixed in the motor permanent seat 560. The drive motor 550 is provided in the battery compartment 120 by using the motor permanent seat 560, the assembling and disassembling of drive motor 550 is convenient. The outer part of the barrel 100 is provided with a case 600, and the case 600 is made of paraffin or glass. The outer part of the barrel 100 is provided with the case 600 which is made of paraffin, so that the shape of the electronic fountain light of the present disclosure is closer to a traditional mineral candle.

Furthermore, a loudspeaker (not shown) and a control chip (not shown) are also arranged in the battery compartment 120, the loudspeaker is electrically connected with the control chip, and the control chip is provided with a program loading module. In the process of using the electronic fountain light of the present disclosure, by using of program loading module to load different music and control programs, the control chip operates a control loudspeaker to play music and controls the first illuminant 400 to twinkle the light and also controls the drive motor 550 to rotate, thus making a water jet frequency of the electronic fountain light of the present disclosure in accordance with a music rhythm, the light twinkles with the rhythm of the music.

The present disclosure is not limited to the disclosure. The related technical fields are included within the scope of the patent protection of the present disclosure. The foregoing descriptions are merely embodiments of the present disclosure, and are not intended to limit the scope of the present disclosure. An equivalent structural or equivalent process alternation made by using the content of the specification and drawings of the present disclosure, or an application of the content of the specification and drawings directly or indirectly to another related technical field, shall fall within the protection scope of the present disclosure.

I claim:

1. An electronic fountain light, comprising:

a barrel;

a separator, provided in a cavity of the barrel and configured to divide the barrel into a water storage compartment and a battery compartment;

a first water tank, provided in the water storage compartment;

a first illuminant, provided on the separator;

a mounting slot, formed by that the separator is provided in a concave manner along a direction towards the battery compartment;

an impeller, mounted in the mounting slot;

a plurality of first magnets, fixed on the impeller;

a rotating disk, disposed in the battery compartment;

a drive motor, disposed in the battery compartment and configured for driving the rotating disk to rotate;

a plurality of second magnets, mounted on the rotating disk;

a water outlet pipe, disposed in the water storage compartment; and a circulating waterway, formed by the water storage compartment, the mounting slot, a water outlet pipe and the first water tank; wherein, the drive motor drives the rotating disk to rotate, and by means of mutual attraction of the second magnets and the first magnets, the impeller is driven to rotate; an end of the water outlet pipe, is in communication with the mounting slot; and the other end of the water outlet pipe is directly or indirectly in communication with the first water tank.

2. The electronic fountain light of claim 1, wherein the first water tank is provided with a water outlet, and an accommodation cavity is provided to communicate with the water outlet, and a candle flame simulation device is installed in the accommodation cavity.

3. The electronic fountain light of claim 2, wherein an inner wall of the accommodation cavity is provided with a second illuminant, and an elevation angle of light emitted by the second illuminant is an acute angle.

4. The electronic fountain light of claim 2, wherein the first water tank is provided with light guiding fiber, one end of the light guiding fiber is fixed on the inner wall of the accommodation cavity, the other end of the light guiding fiber is extended to the first illuminant, the light guiding fiber makes the light emitted by the first illuminant irradiate the candle flame simulation device, the elevation angle of light emitted by the light guiding fiber is the acute angle.

5. The electronic fountain light of claim 2, wherein the flame simulation device comprises a candle flame simulation plate, extended out of the water outlet; and a floating, arranged in the accommodation cavity, the float is made of a solid buoyancy material, a bottom end of the candle flame simulation plate is fixed on the floating, a pivot is convexly disposed on a periphery wall of the floating, the floating is positioned in the accommodation cavity by using the pivot.

6. The electronic fountain light of claim 5, wherein the floating is connected with a weight ball by using a cable line, the counterweight ball is disposed in the cavity of the first water tank.

7. The electronic fountain light of claim 1, wherein a plurality of first magnets is evenly interval disposed on the impeller, and a plurality of second magnets is evenly interval disposed on the rotating disk.

8. The electronic fountain light of claim 1, wherein the separator is provided in concave manner along a direction towards the water storage compartment to have a light cover, the first illuminant is accommodated in the light cover, the light cover is arranged below the first water tank.

9. The electronic fountain light of claim 8, wherein a gap is arranged between side walls of the first water tank and the water storage compartment.

10. The electronic fountain light of claim 9, wherein the water outlet pipe is disposed on the separator, a hollow joint is provided on one end of the water outlet pipe which is away from the mounting slot, a water inlet is provided at a bottom of the first water tank, the water inlet is communicated with the joint.

11. The electronic fountain light of claim 9, wherein the water outlet pipe is disposed on a sidewall of the water storage compartment, an effluent nozzle is provided on one end of the water outlet pipe which is away from the mounting slot, a water outlet of the effluent nozzle is provided facing lateral of the first water tank.

12. The electronic fountain light of claim 11, wherein the first water tank is provided with an opening; the bottom of the first water tank is connected with the separator.

13. The electronic fountain light of claim 12, wherein a plurality of secondary water tanks is stacked at a top of the first water tank.

14. The electronic fountain light of claim 13, wherein a height of the secondary water tanks which are located at the top level is lower than that of the effluent nozzle.

15. The electronic fountain light of claim 1, wherein the barrel and the separator are molded in one body, the barrel, the separator and the first water tank are all transparent or translucent.

16. The electronic fountain light of claim 1, wherein the battery compartment is equipped with a battery pack, the battery pack and the drive motor are electrically connected.

17. The electronic fountain light of claim 16, wherein the battery pack comprises a storage battery and a power adapter to communicate with an external power supply.

18. The electronic fountain light of claim 1, wherein the battery compartment is equipped with a motor permanent seat, the motor permanent seat and the separator are fixedly connected by a screw, the drive motor is fixed in the motor permanent seat.

19. The electronic fountain light of claim 1, wherein a loudspeaker and a control chip are also arranged in the battery compartment, the loudspeaker is electrically connected with the control chip and the control chip is provided with a program loading module.

20. The electronic fountain light of claim 1, wherein an outer part of the barrel is provided with a case and the case is made of paraffin or glass.

* * * * *